United States Patent [19]

Tateyama

[11] 4,275,887

[45] Jun. 30, 1981

[54] PORTABLE MULTIPLE GAME ASSEMBLY

[75] Inventor: Masanobu Tateyama, Matsudo, Japan

[73] Assignee: Takara Co., Ltd., Tokyo, Japan

[21] Appl. No.: 82,060

[22] Filed: Oct. 5, 1979

[51] Int. Cl.[3] ..... A63F 3/00; B42F 17/20

[52] U.S. Cl. ..... 273/239; 273/284; 273/285; 40/372; 40/389

[58] Field of Search ..... 273/284, 285, 287, 239, 273/286; 40/389, 381, 380, 372

[56] References Cited

U.S. PATENT DOCUMENTS

| | | | |
|---|---|---|---|
| 1,699,132 | 1/1929 | Buchanan | 273/284 |
| 2,186,436 | 1/1940 | Shaler | 40/389 |
| 2,524,209 | 10/1950 | Pollock | 40/389 |
| 2,551,213 | 5/1951 | Lang | 40/389 |
| 3,685,170 | 8/1972 | Fairleigh | 273/239 X |
| 3,851,885 | 12/1974 | Pepkowski et al. | 273/239 X |

*Primary Examiner*—Richard C. Pinkham
*Assistant Examiner*—Scott L. Brown
*Attorney, Agent, or Firm*—Jackson, Jones & Price

[57] ABSTRACT

A multiple game assembly that can be carried in a player's pocket is provided. A plurality of game boards are contained within the housing assembly and an exterior indicator can select any specific game. When the housing assembly is open the preselected game board is automatically positioned in an operative mode. Each game sheet includes a magnetizable substrate that is capable of retaining magnetic game pieces.

10 Claims, 5 Drawing Figures

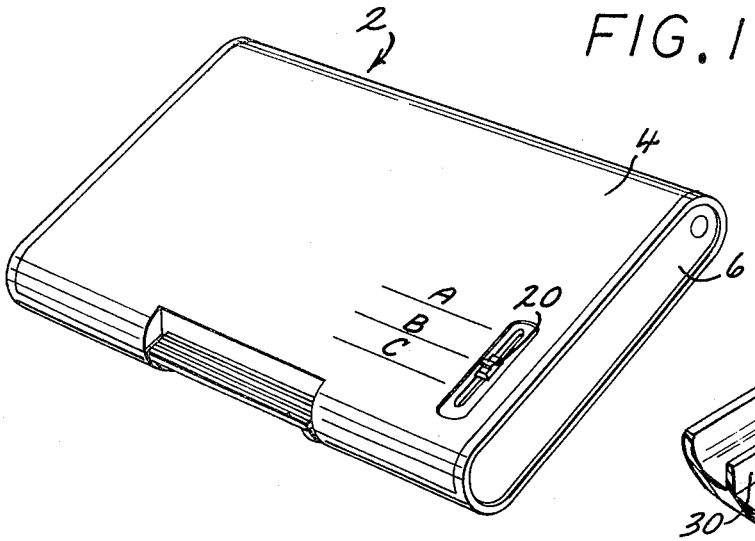
FIG. 1
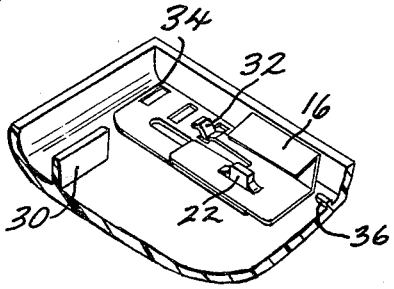
FIG. 3
FIG. 2
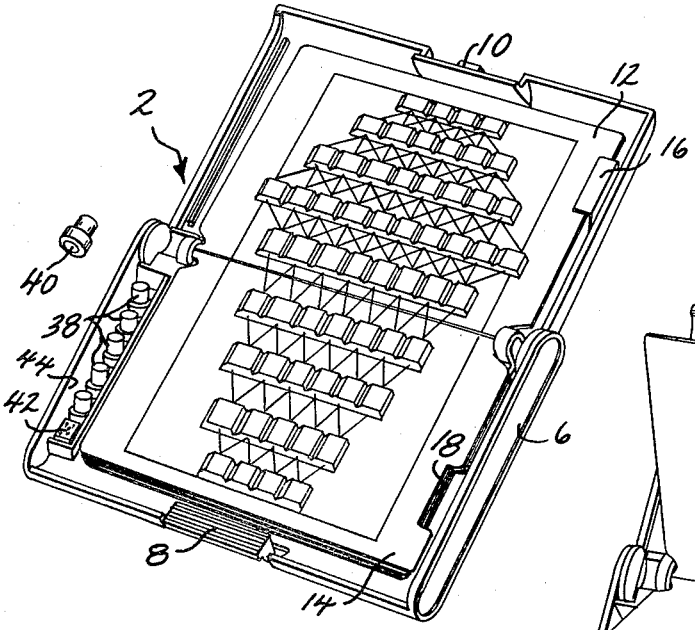
FIG. 4
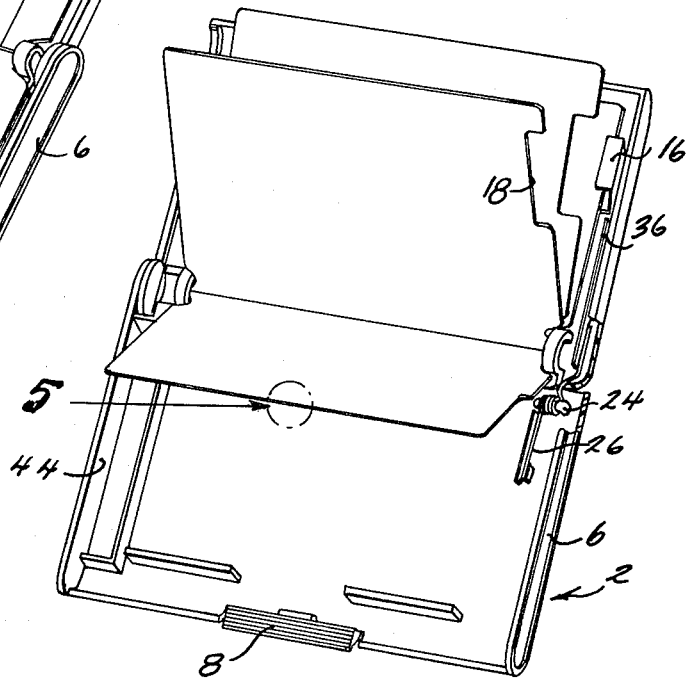
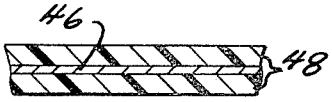
FIG. 5

PORTABLE MULTIPLE GAME ASSEMBLY

BACKGROUND OF THE INVENTION

1. Field of the Invention

The present invention is directed to a multiple game assembly that can be conveniently carried, for example in the pocket of a person and more particularly to a game assembly that permits the player to select a particular game board with a magnetizable substrate and to automatically position the game board upon the opening of the housing assembly.

2. Description of the Prior Art

Numerous toy games of a relatively small size, e.g., pocket games, have been suggested in the prior art such as small pinball games wherein the ball or balls are attempted to be positioned in various indentations in a game board surface. Additionally, it has been known to utilize chess and checker games that can be folded for pocket size portability.

There is still a demand in the prior art to provide a highly versatile multiple game assembly that can be conveniently carried by a player while at the same time providing a relatively stable playing surface for maintaining exact positions of the player's pieces.

SUMMARY OF THE INVENTION

The present invention is directed to a multiple game assembly which includes a bifurcated housing assembly with a base member and a pivotal lid. The pivotal lid is spring biased to an open position. A plurality of individual game sheets are pivotally mounted within the housing assembly. Each sheet may include a magnetizable substrate that can be sandwiched between non-magnetizable material such as plastic to form a laminate. The respective game sheets are stacked in the storage mode when the housing assembly is closed but are capable of being selectively positioned so that a pair of game sheets can be maintained in substantially a horizontal plane for an operative mode of play. Generally, both sides of each game sheet form one-half of a game board for a particular type of game. The peripheral edges of the game sheets can be subjectively indented to identify their relative position in the stacked mode of storage. An exterior lever can be mounted on the pivotal lid and moved by a player to select a particular game in accordance with predetermined appropriate indicia on the lid assembly. Finally, a plurality of game pieces containing magnets can be stored within the housing assembly and selectively adhered to the game board by the players. Minor movements of the game board will, accordingly, not affect the magnetized connection between the game board and the game pieces.

The objects and features of the present invention which are believed to be novel are set forth with particularly in the appended claims. The present invention, both as to its organization and manner of operation, together with further objects and advantages thereof, may best be understood by reference to the following description, taken in connection with the accompanying drawings.

BRIEF DESCRIPTION OF THE DRAWINGS

Referring to FIG. 1 a perspective view of the game assembly in a closed storage position is disclosed;

FIG. 2 discloses a perspective view of the game assembly opened to one particular game board;

FIG. 3 is a partial perspective view of the indexed retainer;

FIG. 4 is a partial perspective view of the game assembly in an open position with spaced game sheets, and FIG. 5 is a cross-sectional view of a game sheet.

DESCRIPTION OF THE PREFERRED EMBODIMENT

The following description is provided to enable any person skilled in the toy industry to make and use the invention and sets forth the best mode contemplated by the inventor of carrying out his invention. Various modifications, however, will remain readily apparent to those skilled in the art, since the generic principles of the present invention have been defined herein specifically to provide a multiple game assembly that is easily portable.

Referring to FIG. 1, a small game assembly 2 is disclosed in its closed or portable storage mode of operation. Basically the housing assembly comprises a pivotal lid 4 that can be snap mounted into a base member 6. Thus, the housing assembly can consist of only two plastic injection molded parts. The pivotal lid 4 can include side mounting posts that are appropriately mounted within bores on the base member 6. As will be subsequently described the lid member 4 and the base member 6 can be spring biased to an open position. As seen in FIG. 2, a cantilever keeper 8 that extends upward from the base member 6 is dimensioned for a snap locking action on a latch member 10 positioned on the pivotal lid 4. This latch and keeper assembly is more than adequate to maintain the lid 4 and base member 6 locked together against the relatively weak bias of the spring force.

As can be seen on FIG. 1, a selection lever 20 is movable in an elongated opening in the pivotal lid 4 and appropriate indicia, which for purposes of illustration has been simply identified as games A, B and C are placed adjacent selected travel positions of the selection lever 20. Thus a player or operator can manipulate the selection lever 20 to a desired game indicia and when the keeper latch assembly is released the game assembly 2 will automatically open to the desired game board configuration as shown in FIG. 2.

A plurality of playing board sheets such as 12 and 14 are pivotally mounted within the game assembly 2. Generally, each game sheet comprises one half of a playing board and the play action is designed to extend across two sheets when the game sheets are maintained in substantially the same plane for an operative mode of operation as shown in FIG. 2 wherein the playing sheets 12 and 14 comprise a single game board. Each of the game sheets are provided with means for identifying its relative position when placed into a stacked storage mode with the lid 4 closed and this is accomplished with the provision of indented edges on one side of the game sheets. Thus, the recess 18 subjectively identifies the corresponding game sheet 14. Different size recesses are provided on most of the other game sheets to permit appropriate identification. As can be easily recognized one game sheet can be provided without a recess and this fact alone will identify its position in the stack. The game sheets are pivotally mounted and can be removed if desired from the game assembly.

A sliding retainer 16 which can be formed from a single bent metal member is relatively dimensioned to interface with the game sheet recesses for either attachment to or release from the pivoted lid member 4. The selection lever 20 can be attached to the sliding retainer 16 by a lower post member 22 that extends through an opening in the retainer 16 and is friction retained by spring-like teeth extending into the bore. The sliding retainer 16 can further include an integral spring keeper or cantilevered member 32 that is biased against the internal surface of the pivotal lid 4. Appropriately spaced indents 34 provide bias positions for the sliding retainer 16 and are further appropriately correlated with both the recessed openings on the edges of the game sheets and the game indicating indicia on the surface of the pivotal lid 4.

A support bar 30 is positioned on the interior surface of the lid member 4 to hold the respective game sheets in a relatively horizontal position when the game assembly is in an open operative mode on a flat support surface. A similar lower support bar is provided on the base member 6 to perform the same function. A coiled spring 26 with extended ends is mounted on a mounting post 24 which extends upward from the surface of the base member 6. A side guide bar 36 can be integrally molded on the interior surface of the pivotal lid 4 to help maintain the position of the spring 26.

An elongated storage box 44 can also be integrally molded with the base member 6 for purposes of maintaining the playing pieces 38 and a die 42. Each of the playing pieces can be color coordinated and further include a magnet 40. As can be appreciated, one or more of the playing pieces are designed for interchangeable use in each of the games.

Referring to FIG. 5, a cross-sectional view of a single game sheet disclosed in FIG. 4 is presented. A magnetizable substrate 46 such as a thin flexible piece of iron can be sandwiched by non-magnetizable exterior layers having appropriate game indicia. The exterior layers can simply include either paper or plastic sheets that are bonded to form a laminate structure.

As can be readily appreciated, a game assembly that is easily portable is provided by the present invention. The game assembly can be conveniently fitted into a pocket because it is relatively thin, e.g., one-half inch with a dimension of approximately three by four inches.

A player can manipulate the selection lever 20 to select a desired game. When the pivotal lid 4 is released from the base member 6 by depression of the keeper 8, the desired game board will automatically be formed when the pivotal lid 4 opens to an operative game mode. The selection lever 20 having moved the sliding retainer 16 to a position adjacent the indented edge of a game sheet whereby simply opening the lid member 4 will automatically provide the preselected game board desired. The game pieces 38 can then be appropriately positioned and their magnets 40 will insure that the game pieces are fixed or attached to the individual game sheets that include a magnetizable substrate. The players, depending on the particular rules of the specific game, can then move the game pieces 38, for example, in response to the throwing of the die 42 to enjoy the game.

Since various modifications of the present invention are possible in light of the generic principles of the present invention, the scope of the present invention should be determined solely from the following claims wherein I claim.

What is claimed is:

1. An approximately pocket size multiple toy game assembly comprising:

a housing assembly having a base member and a pivotal lid of a dimensional configuration suitable for portability in the pocket of a player;

a plurality of game sheets pivotally mounted within the housing assembly, each game sheet is a flexible laminate with a magnetizable substrate sandwiched by nonmagnetizable exterior layers of appropriate game indicia, the respective game sheets are stored in a stack mode when the housing assembly is closed and at least one surface of each game sheet forms a portion of a game board;

means for selecting a particular game sheet including an exterior lever capable of being moved to a predetermined position adjacent appropriate indicia on the housing assembly;

means responsive to the position of the lever for securing at least one game sheet to the lid whereby the opening of the housing assembly automatically provides a game board formed from a pair of game sheets;

a plurality of game pieces containing magnets for adhesion to the magnetizable substrate; and a storage box assembly mounted on the base member adjacent one side of the stacked game sheets for holding the game pieces.

2. The invention of claim 1 wherein a spring member biases the lid to an open position.

3. The invention of claim 2 wherein a plurality of game sheets are indented to identify their relative position in a stack mode of storage.

4. The invention of claim 3 wherein the means for selecting a particular game further includes a movable retainer member mounted on the lid member adjacent the indented edges of the game sheets and an integral spring keeper extending from the retainer for biasing the retainer member to preselected positions.

5. The invention of claim 1 wherein a support bar is positioned on the interior surface of the lid to position the game sheets.

6. An approximately pocket size multiple toy game assembly comprising:

a housing assembly having a base member and a pivotal lid of a dimensional configuration suitable for portability in the pocket of a player, the lid having an aperture with internal indentations adjacent the aperture;

a plurality of game sheets pivotally mounted within the housing assembly, each game sheet is a laminate with the magnetizable substrate sandwiched by nonmagnetizable exterior layers of appropriate game indicia, the respective game sheets are stored in a stack mode when the housing assembly is closed and at least one surface of each game sheet forms a portion of a game board;

means for selecting a particular game sheet including an exterior lever extending through the aperture of the lid and mounted for movement to a predetermined position adjacent appropriate indicia on the exterior of the lid and a one piece slidably mounted retainer for encompassing the side edge of the game sheets including an integral spring keeper that is biased against the internal surface indentations of the lid; and a plurality of game pieces containing magnets for adhesion to the magnetizable substrate.

7. The invention of claim 6 further including storage box assembly on the base member adjacent one side of the stacked game sheets for holding the game pieces.

8. The invention of claim 7 wherein a plurality of game sheets are indented along their periphery to identify their relative position in a stack mode of storage.

9. The invention of claim 7 wherein a spring member biases the lid to an open position.

10. The invention of claim 9 wherein a support bar is positioned on the interior surface of the lid to position the game sheets.

* * * * *